US005590492A

United States Patent [19]

Cucchiara et al.

[11] Patent Number: 5,590,492

[45] Date of Patent: Jan. 7, 1997

[54] ROOF DRAINAGE SYSTEM

[76] Inventors: Lewis P. Cucchiara; Francine A. Cucchiara, both of 141 Waldorf Ave., Rochester, N.Y. 14606; Thomas C. Delgudico, 135 Brower Rd., Spencerport, N.Y. 14559

[21] Appl. No.: 514,803

[22] Filed: Aug. 14, 1995

[51] Int. Cl.[6] ..... E04D 13/00

[52] U.S. Cl. ..... 52/15; 52/11; 52/13; 52/16; 52/94; 52/95; 52/96

[58] Field of Search ..... 52/11, 13, 14, 52/15, 16, 94–96

[56] References Cited

U.S. PATENT DOCUMENTS

| | | | |
|---|---|---|---|
| 2,896,559 | 7/1959 | Stephens | 52/94 |
| 3,084,479 | 4/1963 | Struben | 52/94 X |
| 3,271,913 | 9/1966 | Fields | 52/95 X |
| 3,389,513 | 6/1968 | Ruggles | 52/16 X |
| 3,824,749 | 7/1974 | Scherf | 52/94 X |
| 4,100,703 | 7/1978 | Sickler | 52/16 |
| 4,106,243 | 8/1978 | Horn | 52/94 X |
| 4,254,594 | 3/1981 | Hammond et al. | 52/94 X |
| 4,261,143 | 4/1981 | Rizzo | 52/16 |
| 4,951,430 | 8/1990 | Gottlieb | 52/16 X |

*Primary Examiner*—Wynn E. Wood
*Attorney, Agent, or Firm*—Robert J. Bird

[57] ABSTRACT

A roof drainage system includes an eve trough with end walls keyed for placement on the bottom edge of a fascia, a building corner post forming a drain spout within it, and a soffit channel connecting the eve trough to the drain spout. An alternative eve trough is formed in a horizontal siding member having front and back walls and an inner bottom together forming a water channel at an incline from horizontal.

6 Claims, 5 Drawing Sheets

FIG. 1
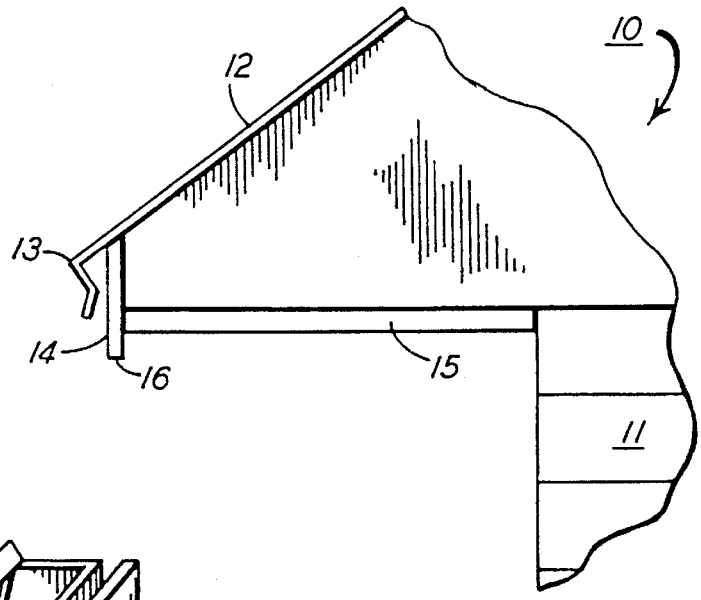
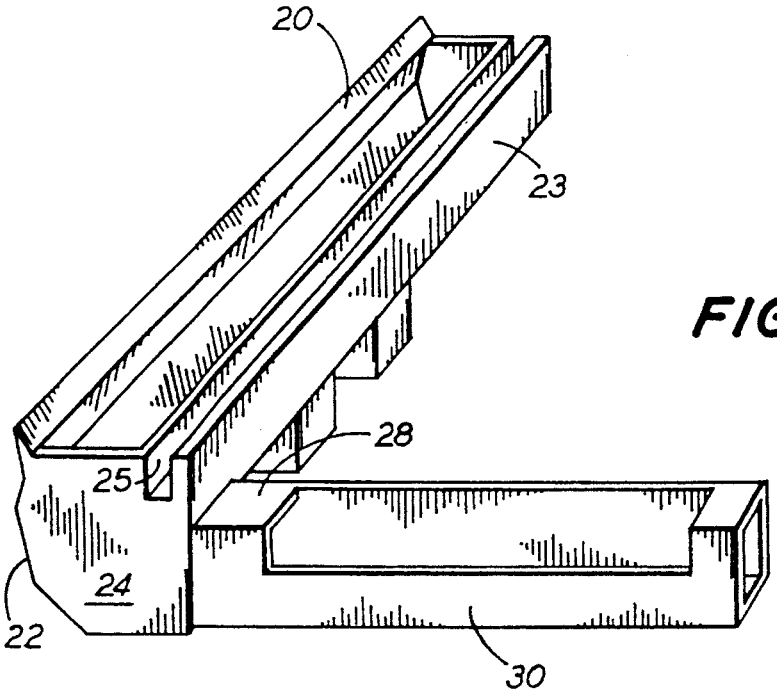
FIG. 2
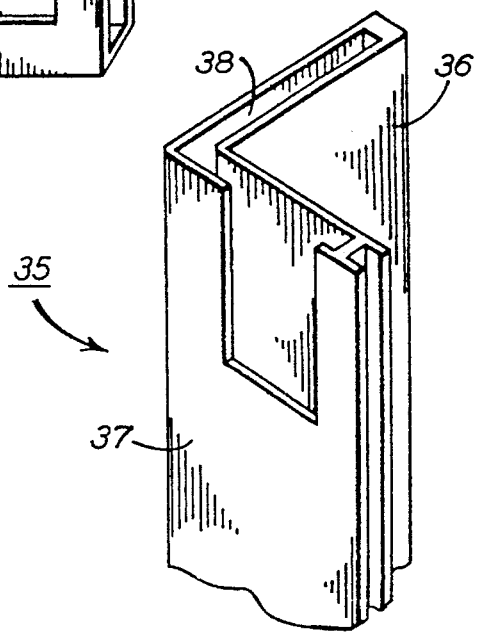
FIG. 3

ROOF DRAINAGE SYSTEM

BACKGROUND AND INFORMATION DISCLOSURE

This invention is a roof drainage system. More specifically, it is an aesthetic variation on existing gutter and downspout systems.

Conventional gutter and downspout systems typically include horizontal gutters mounted below and along roof edges and connected to vertical downspouts by elbows, These members are mounted on the exterior of their respective supporting structures. Gutters mounted on supporting fascias, downspouts mounted on vertical corner columns, and elbows connecting them are all in full view. These members are purely functional and inherently less appealing aesthetically than the structure on which they are mounted, and from which they distract.

Such conventional gutter and downspout systems are the most relevant prior art that we know of.

It is an object of this invention to provide roof drainage systems in which gutters and downspouts, as pieces separate from structure, are eliminated and their functions performed by other structural members.

SUMMARY OF THE INVENTION

A roof drainage system according to this invention includes an eve trough with end walls keyed for placement on the bottom edge of a fascia, a building corner post forming a drain spout within it, and a soffit channel connecting the eve trough to the drain spout. An alternative eve trough is formed in a horizontal siding member having front and back walls and an inner bottom together forming a water channel at an incline from horizontal.

DRAWING

FIG. 1 is a side sectional view of a standard roof construction, showing roof, fascia, and soffit.

FIG. 2 is a pictorial view of an eve trough and partial soffit channel of this invention.

FIG. 3 is a pictorial view of a vertical spout.

DESCRIPTION OF PREFERRED EMBODIMENT(S)

Figure 4:
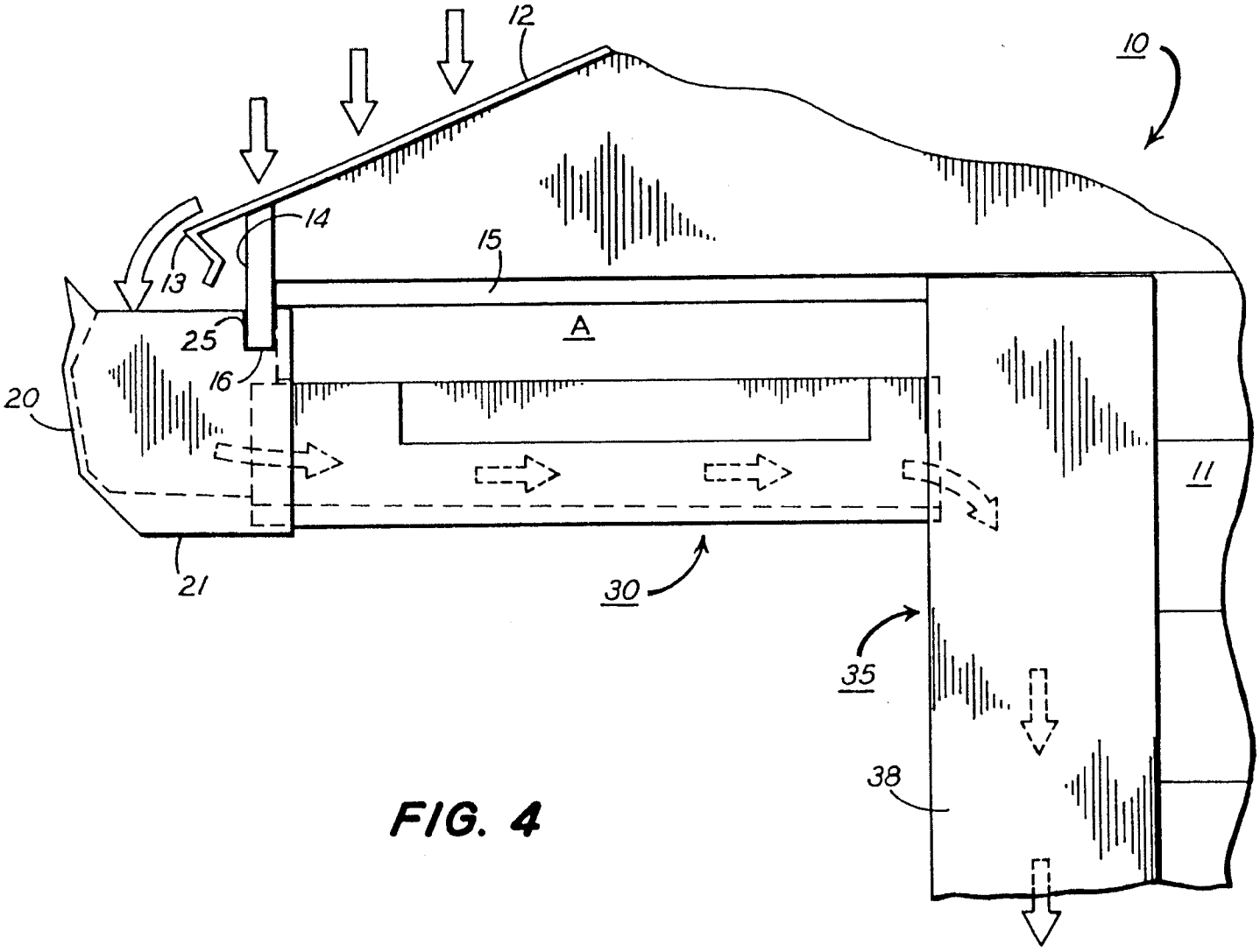
FIG. 4 is a side view of a combined eve trough, soffit channel, and drain spout.

FIG. 1 represents the environment of this invention. A building 10 includes a wall 11 and an overhanging roof 12 with a lower edge 13. The structure further includes a fascia 14 along the roof edge 13, and a soffit 15 below the overhanging portion of the roof. The lower edge 16 of the fascia 14 typically extends somewhat below the soffit 15.

FIG. 4 shows the basic structure of FIG. 1, with the addition of our soffit channel system. The soffit channel system is a combination of an eve trough 20 positioned and mounted relative to the lower edge 16 of the fascia, and a soffit channel 30 extending from the eve trough 20 to a corner post drain spout 35. A cover plate or face plate, not shown, will cover the end of the soffit in the area A of FIG. 4.

Figure 5:
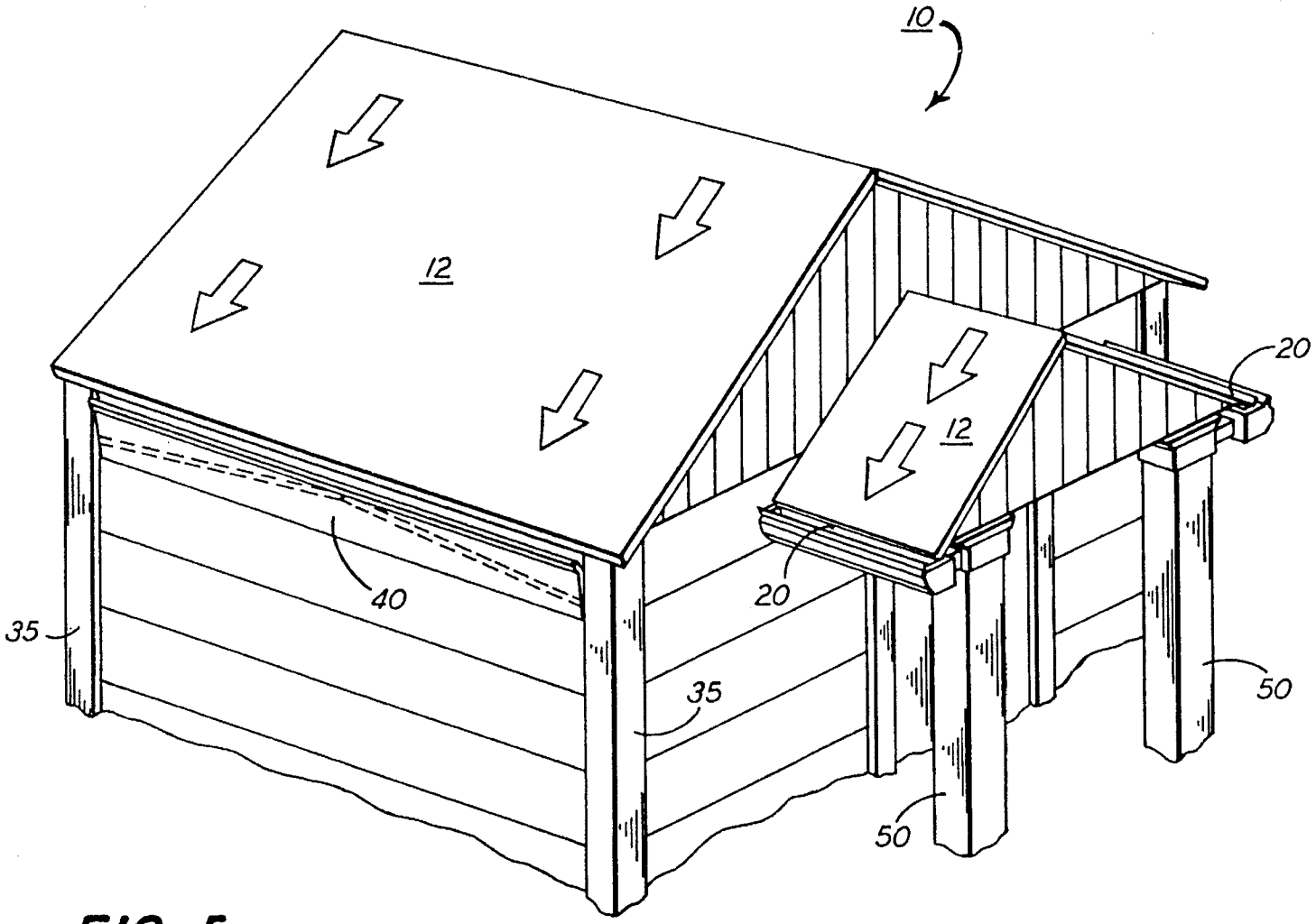
FIG. 5 shows a building with our channel drainage system, including a siding channel system on the main part and a soffit channel system on the extension.
Figure 6:
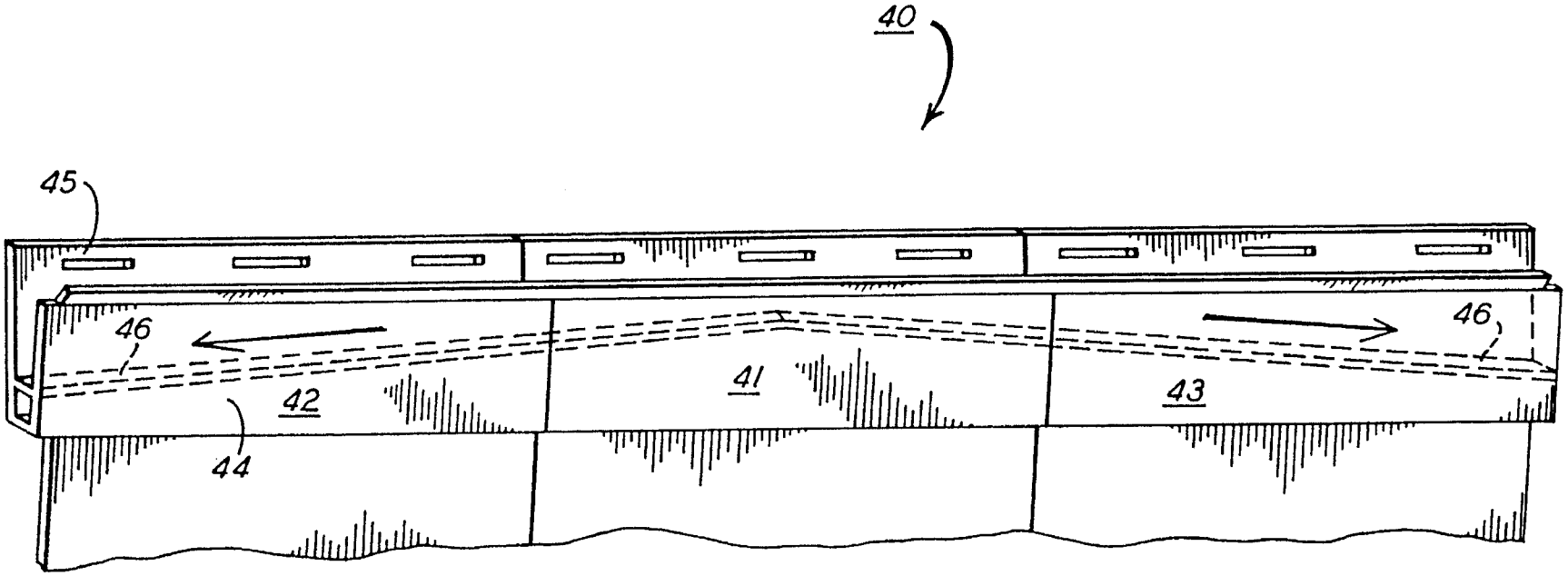
FIG. 6 shows a siding channel.

The arrows in FIGS. 4–6 represent water flow.

FIG. 2 is a pictorial view of the eve trough 20 and the soffit channel 30. The eve trough 20 is an elongated channel with a bottom 21, front and back walls 22, 23 and an open top to catch water from the roof. End plates 24 on the eve trough include notches 25 to fit over the lower edge 16 of the fascia to properly position the eve trough relative to the fascia and the roof edge. The eve trough 20 is adapted for mounting and fastening to the underside of the soffit 15. The eve trough 20 includes a rear extension 28 at its near end which leads into the soffit channel 30.

FIG. 3 shows, from an elevated position, a combination corner post and drain spout or spout post 35. The spout post 35 includes L-shaped inner and outer wails 36 and 37 forming a vertical drain conduit 38 between them. The soffit channel 30 (FIG. 2) leads into the drain spout 35 at or near its top. This completes the water path from the roof, to the eve trough 20, to the soffit channel 30, to the vertical drain conduit 38, to the ground. As seen in FIG. 3, the spout post 35 appears as a corner post, not as a downspout.

FIG. 5 shows a building 10 with the above-described soffit channel system on a right end extension, where the roof 12 is overhanging, and where there are soffits. To the left, in the main part of the building, there is little or no roof overhang and no soffits. Here the roof drainage is provided by our "siding channel system". One horizontal siding member is a combination siding board and water channel, or siding channel 40. From the front it appears substantially the same as the other siding members below it. The siding channel 40 connects with a spout post 35 to connect their water channels.

As best seen in FIG. 6, the siding channel member 40 includes a central section 41, a left end section 42, and a right end section 43. The central section 41 is partially broken away to show inner details. Each section 41, 42, 43, includes front and back walls 44, 45 forming a water channel 46 between them. The channel in the central section 41 is sloped downward in both directions from the center by interior molding. The channel in the left end section 42 is sloped down to the left to form a continuous downward channel when joined to the central section 41. Similarly, the channel in the right end section 43 is sloped down to the right to form a continuous downward channel when joined to the central section 41. The channel sections 41, 42, 43 are adapted for mounting and fastening to building where appropriate, such as just below the roof edge, for example. Sloping of the channel downward from the center is only exemplary; slope might also be continuously downward from one end to the other.

Figure 7:
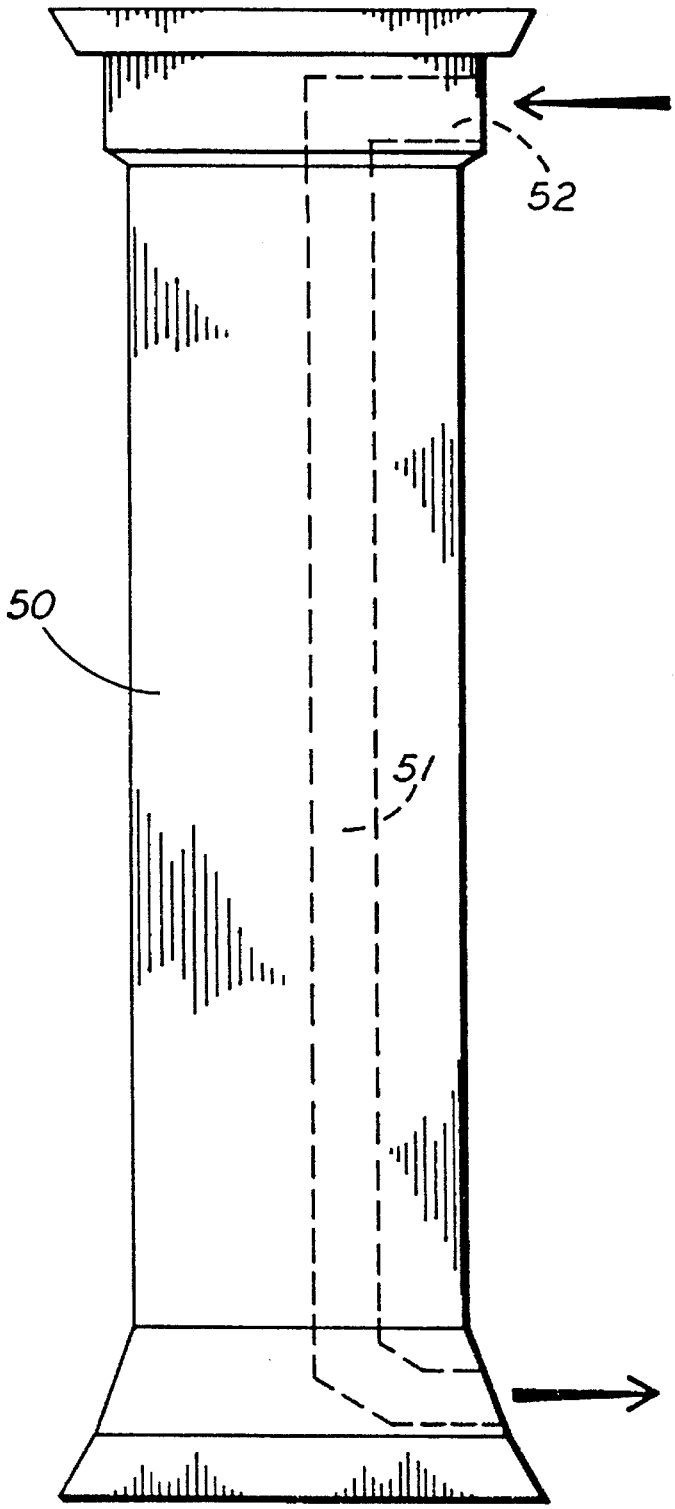
FIG. 7 shows a combination pillar and drain spout.

FIG. 7 shows a combination pillar and drain spout or spout post 50. The spout post 50, functionally equivalent to the corner spout post 35 of FIG. 3 but for use with pillars under porch roofs or overhangs, similarly includes an internal drain conduit 51 (shown in hidden lines) with a top opening 52 for connection to a soffit channel 30 as in FIG. 5.

The spout posts 35 and 50 may be connected and used with standard gutters and elbows, in the event it is desired to retain standard gutters and replace only the downspouts with our spout posts.

Standard gutters of the prior art are typically inclined at some angle from the horizontal to make water flow to a downspout. In our drainage system, the horizontal members are truly horizontal because they are intended to appear as part of the building structure. To provide the necessary slope for gravity water flow, the horizontal channel members 20, 30, 40 all include

What is claimed is:

1. A roof drainage system attach to a building having an overhanging roof with a fascia along the edge thereof and a soffit below the roof overhang, said drainage system including:

an eve trough including an elongated water channel with end walls keyed to fit onto the bottom edge of said fascia;

a corner post forming a drain spout therewithin and extending up a corner of said building: and a soffit channel extending from said eve trough to said drain spout.

2. A roof drainage system as defined in claim 1 in which said corner post has an L-shaped cross section with inner and outer walls defining said drain spout.

3. A building roof drainage system including a combination horizontal siding member and eve trough;

said member adapted for horizontal mounting as siding for said building;

said member having front and back walls and an inner bottom together forming therein a water channel at an incline from horizontal;

said siding member including a central section in which said channel slopes down in both directions from the center thereof a left end section in which said channel slopes down to the left from said central section, and a right end section in which said channel slopes down to the right from said central section.

4. A roof drainage system as defined in claim 3, further including a combination pillar and spout post operatively connected with said eve trough.

5. A roof drainage system as defined in claim 3, further including a combination corner post and spout post operatively connected with said eve trough.

6. A roof drainage system attached to a building having an overhanging roof with a fascia along the edge thereof and a soffit below the roof overhang, said drainage system including:

an eve trough including an elongated water channel with end walls, each said end wall including a notch to fit on the bottom edge of said fascia;

a corner post forming a drain spout therewithin and extending up a corner of said building; and a soffit channel extending from said eve trough to said drain spout.

* * * * *